US009180355B1

(12) United States Patent
Boehner

(10) Patent No.: US 9,180,355 B1
(45) Date of Patent: Nov. 10, 2015

(54) SYSTEM AND METHOD TO PITCH BALLS WITH FINE ADJUSTMENT

(71) Applicant: Sports Attack, Inc., Verdi, NV (US)

(72) Inventor: Douglas L Boehner, Verdi, NV (US)

(73) Assignee: Sports Attack, Inc., Verdi, NV (US)

( * ) Notice: Subject to any disclaimer, the term of this patent is extended or adjusted under 35 U.S.C. 154(b) by 0 days.

(21) Appl. No.: 14/640,187

(22) Filed: Mar. 6, 2015

(51) Int. Cl.
*F41B 4/00* (2006.01)
*A63B 69/40* (2006.01)
*A63B 69/00* (2006.01)

(52) U.S. Cl.
CPC ..... *A63B 69/406* (2013.01); *A63B 69/0002* (2013.01); *F41B 4/00* (2013.01); *A63B 2069/0008* (2013.01)

(58) Field of Classification Search
CPC .... A63B 69/385; A63B 69/40; A63B 69/406; F41B 4/00
See application file for complete search history.

(56) References Cited

U.S. PATENT DOCUMENTS

| | | | | | |
|---|---|---|---|---|---|
| 3,774,584 | A * | 11/1973 | Paulson | ..... | 124/78 |
| 4,086,903 | A * | 5/1978 | Scott | ..... | 124/78 |
| 6,415,782 | B1 * | 7/2002 | Holland | ..... | 124/78 |
| 6,732,724 | B1 * | 5/2004 | Paulson et al. | ..... | 124/6 |
| 6,863,059 | B1 * | 3/2005 | Lee | ..... | 124/6 |
| 7,040,309 | B2 * | 5/2006 | Johndreau et al. | ..... | 124/80 |
| 8,001,954 | B2 | 8/2011 | Boehner | | |
| 2012/0097145 | A1 * | 4/2012 | Lu | ..... | 124/78 |

* cited by examiner

*Primary Examiner* — John Ricci
(74) *Attorney, Agent, or Firm* — Marc D. Foodman

(57) ABSTRACT

A system and method to pitch balls with a fine adjustment subsystem. The system and method allow an operator to make fine adjustments to the horizontal trajectory of a ball as it passes in front of the hitter. The system includes a throwing head with at least one wheel powered by a motor and a control panel with an adjustment for each motor so that speed and spin imparted to the ball can be changed. This invention further includes a method for pitching practice balls wherein the balls are delivered to a person in need of hitting practice. The fine adjustment subsystem permits an operator to quickly and easily change the horizontal positioning of the balls that are thrown to vary the pitches as a batter practices.

20 Claims, 6 Drawing Sheets

SYSTEM AND METHOD TO PITCH BALLS WITH FINE ADJUSTMENT

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

This invention relates to devices for practicing sports, and in particular, this invention relates to a system and method for simulating a pitched or thrown ball such as a baseball or softball.

Currently, there are many devices for throwing a ball, including the throwing of baseballs and softballs as well as cricket balls, lacrosse balls, tennis balls, etc. for players to practice with. Typically these devices have one or more wheels that engage the ball as it passes through the wheels and impart speed and spin to the ball. Two wheel devices have become the standard over the past several years while three wheel devices are also becoming more common. It should be understood that devices using two wheels are limited in orientation to one plane of motion and are strictly limited in the amount of spin they can impart to the ball as it passes through. The three wheel devices offer an improved experience because they can vary the pitch in two planes of motion providing a more realistic pitch compared to a person throwing the ball.

An advantage of any of the different configurations equipped with a single wheel, two wheels or three wheels is that they are very good at replicating a particular pitch with the same speed, trajectory and spin. The machine can be adjusted manually by an operator moving the entire machine from side to side or by raising or lowering the throwing head. A significant problem that exists is that it is difficult to quickly and easily apply a fine adjustment to the positioning of the device so that over a 60 foot, 6 inch trajectory (the equivalent of the distance between the pitcher's mound and home plate in a major league baseball diamond), a slight change in the side-to-side and/or up-down end position can be achieved. A fine adjustment mechanism is highly desirable to more realistically replicate the routine of an actual pitcher during an at-bat, who varies the location of the ball with each pitch so that during practice, a batter is seeing a full range of locations around the plate, including inside pitches, outside pitches, high pitches, low pitches and pitches throughout the different parts of the strike zone, just as s/he would in a real game.

SUMMARY

The present invention provides an apparatus and method for throwing practice balls that may be presented to a person in need of hitting practice by using an apparatus for pitching practice balls including a support for a ball propelling head, at least one variable speed motor powered wheel to propel a ball dropped into the ball propelling head attached to a pivotable frame; a control panel attached to the support providing access to a speed control for each motor driving a ball propelling head. This invention also provides a method for pitching practice balls wherein the balls are delivered to a person in need of hitting practice balls that pass through an aperture (or opening) formed between: (a) a single powered wheel and a fixed object; or (b) between two or more powered wheels. The motor driven ball propelling head is supported by a frame that is pivotable to aim the ball and includes a fine adjustment subsystem that allows the location of the ball as it passes over the plate to be quickly and easily changed by the operator for each pitch.

The invention is an apparatus for pitching practice balls comprising: a support for a holding ball propelling head some distance above the ground; a pivotable frame for the ball propelling head attached to the support; a mounting plate held by the pivotable frame; a wheel ball propelling head, the head having at least one wheel, the at least one wheel arranged to define an aperture; one motor for each ball propelling head, each motor attached to a wheel, and each motor mounted on a main casting; and a fine adjustment subsystem that allows for quick and easy adjustment of the pitch location between pitches in and around a strike zone of the batter.

Another aspect of the invention is an apparatus for pitching practice of stick-hittable balls comprising: a support for a stick-hittable ball propelling head; a pivotable frame for the stick-hittable ball propelling head attached to the support; a ball propelling head including at least one variable speed motor powered wheel, each wheel attached to a variable speed motor, the at least one wheel defining an aperture through which aperture the stick-hittable ball passes before the stick-hittable ball is launched, and the at least one speed motor attached to a main casting held within and attached to the pivotable frame; a control panel attached proximate the motor plate providing access to a speed control for each motor driving a stick-hittable ball propelling head; and a fine adjustment subsystem that allows for quick and easy adjustment of the pitch location between pitches in and around a strike zone of the batter.

Yet another aspect of the invention is a method for pitching practice balls comprising: delivering practice balls in a practice ball apparatus through an aperture to a person standing in front of the practice ball apparatus to a wheel motor driven ball propelling head supported by a frame that is pivotable to aim the ball; launching the ball to the person standing in front of the apparatus for practicing hitting the launched ball; and quickly and easily adjusting the ball propelling head to change the pitch location between pitches in and around a strike zone of the batter.

BRIEF DESCRIPTION OF THE DRAWINGS

For a better understanding of the present invention, and to show more clearly how it is configured and functions, reference will now be made, by way of example, to the accompanying drawings. The drawings show embodiments of the present invention in which.

DETAILED DESCRIPTION

Figure 1A:
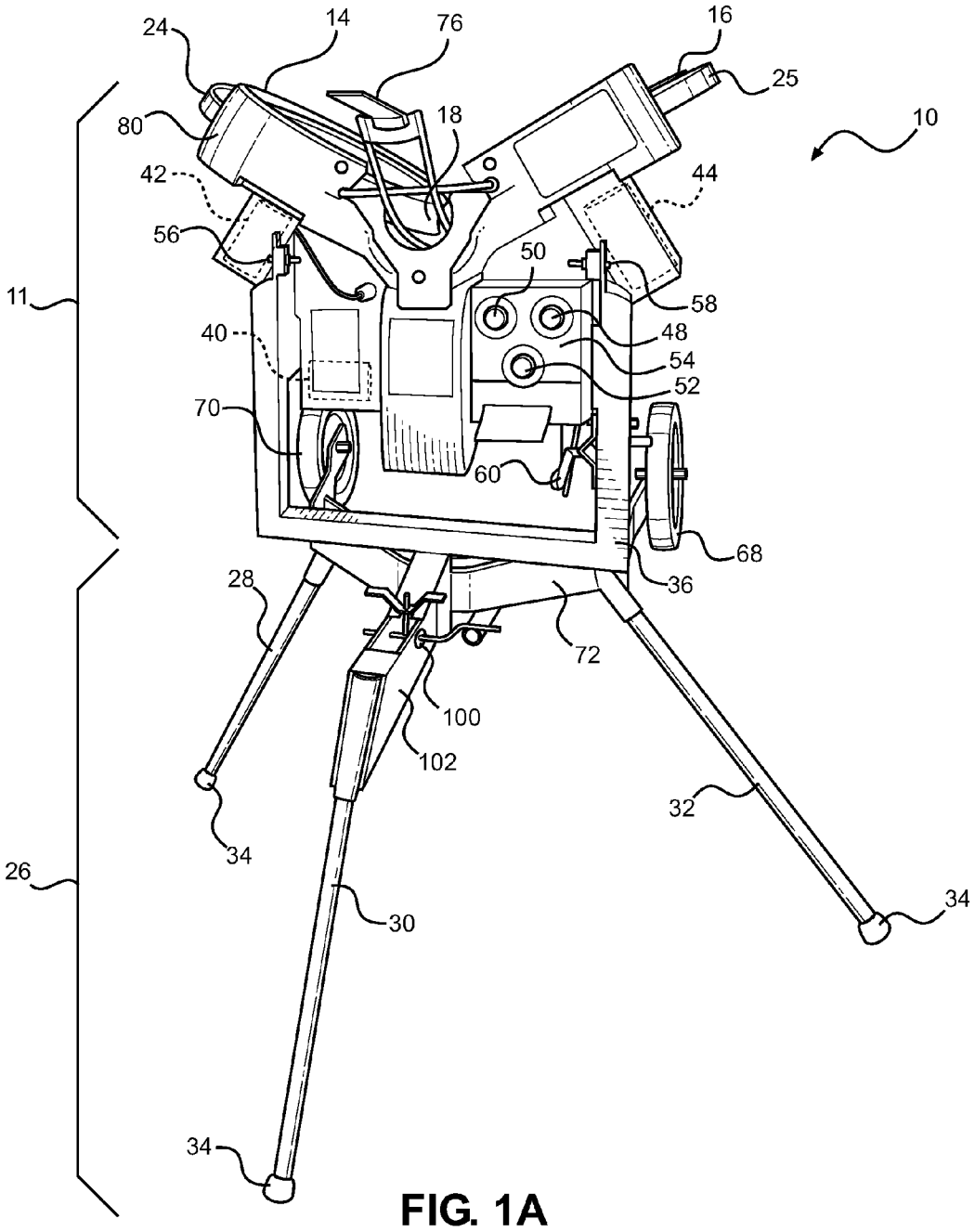
FIGS. 1A-C show perspective views of front, rear and side views of a system to pitch balls.

The present invention will now be described more fully with reference to the accompanying drawings. It should be understood that the invention may be embodied in many different forms and should not be construed as limited to the embodiments set forth herein. Throughout the FIGS. 1-6, like elements of the invention are referred to by the same reference numerals for consistency purposes.

Figure 1B:
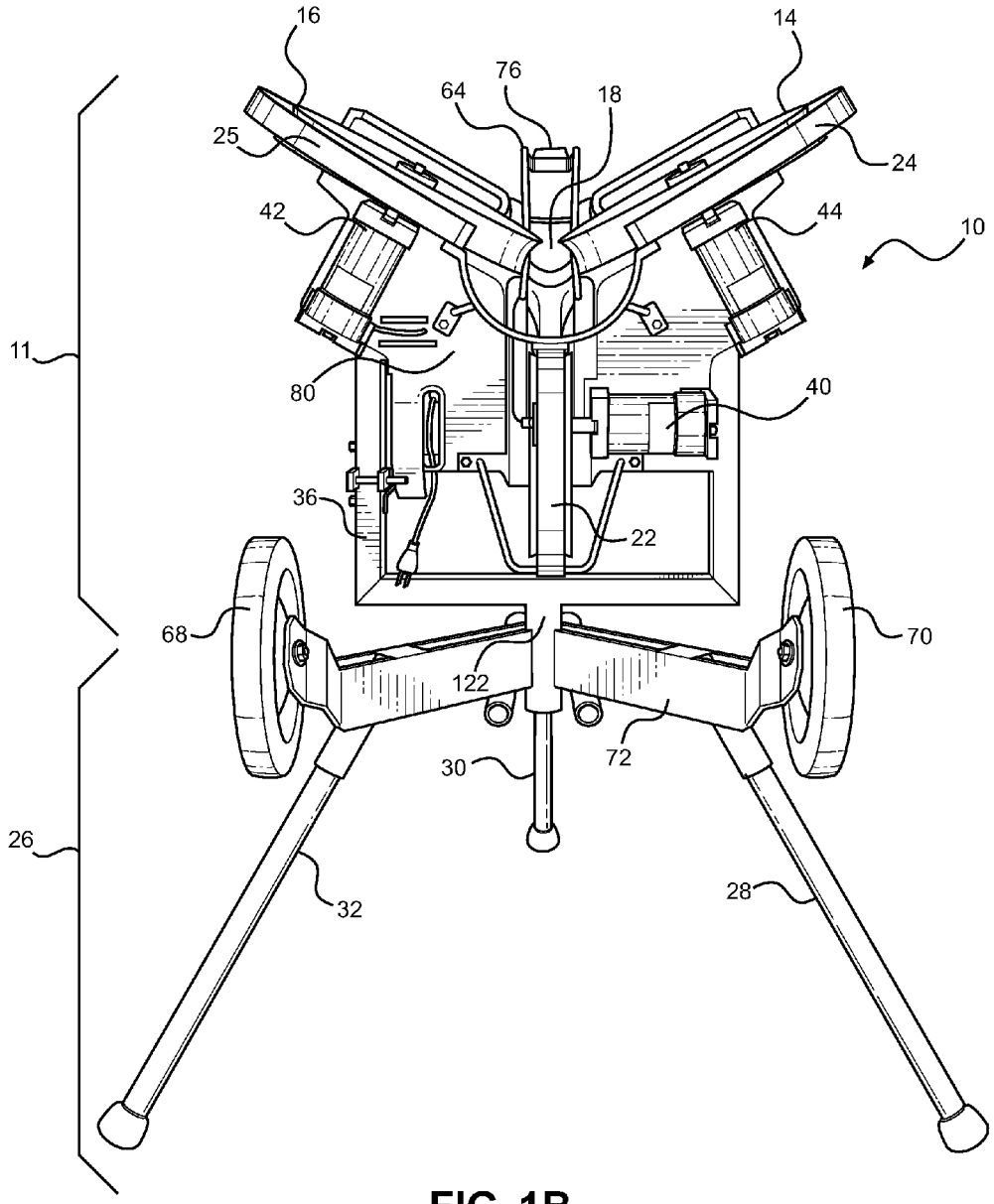
Figure 1C:
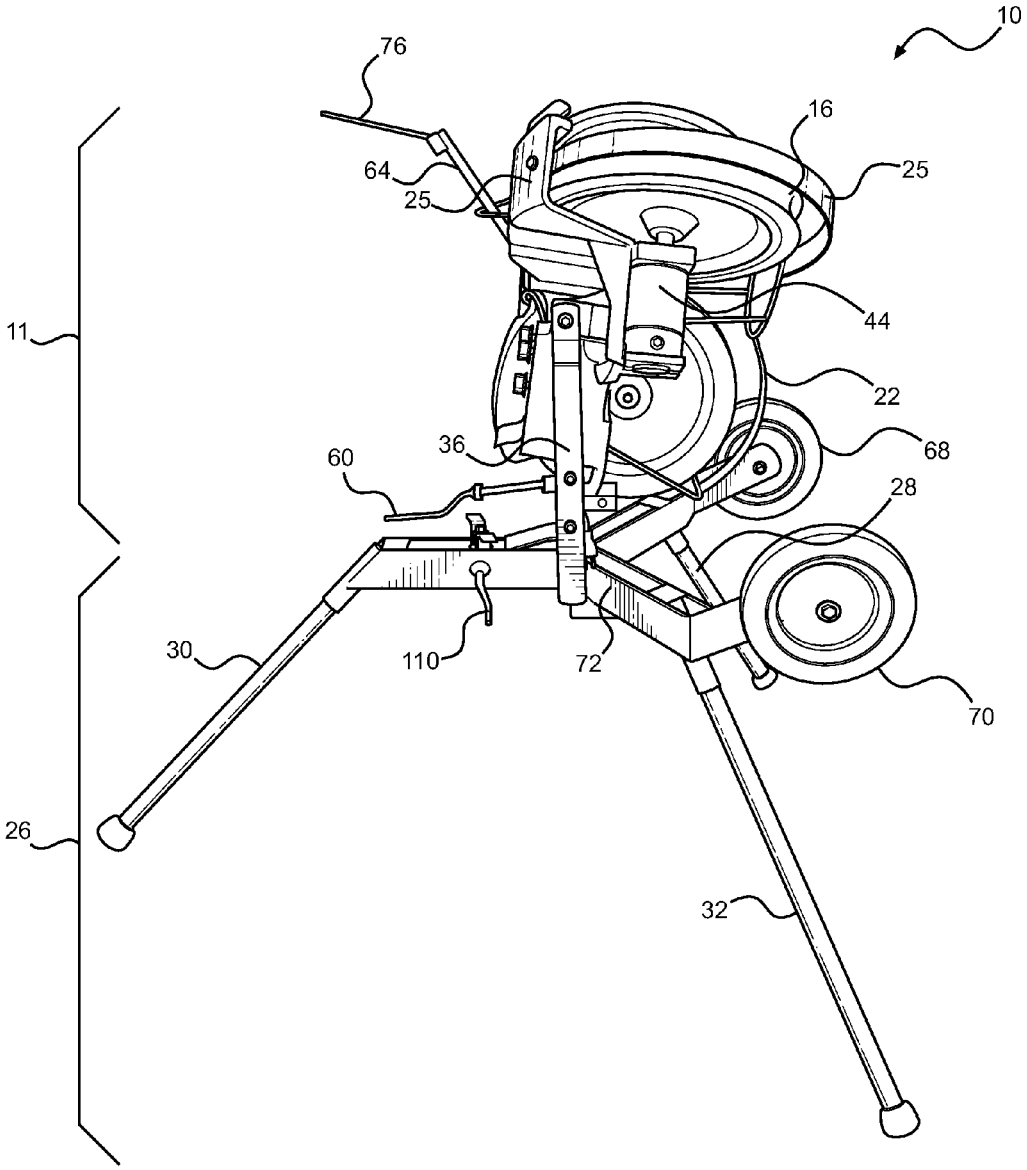

FIGS. 1A-C show three views of a ball pitching apparatus 10 from the front (FIG. 1A), rear (FIG. 1B) and side (FIG. 1C). In describing ball pitching apparatus 10, reference to all three figures is made. Ball pitching apparatus 10 has a three-wheel ball propelling head 11 having three powered wheels 12, 14, and 16. These three wheels contact practice balls, launching them towards player for batting practice, who is usually positioned in front of the apparatus about sixty feet away. It should be understood that the device is adjustable for pitching at other distances, including for purposes of batting practice at the youth level, or for launching practice with fielding of ground balls, line drives or pop flies.

Practice balls are placed on the end of a chute 64 (see FIGS. 2-3), down which the ball rolls. Chute 64 allows the practicing player to see the ball as it approaches an aperture 18 formed between the wheels before the ball contacts wheels 12, 14, 16, and the ball is launched towards the player. This visibility of the ball allows the batter to get a sense of timing in anticipating the release of the ball, allowing him or her to stride forward or whatever that player may do to prepare to hit a pitched ball. In a three wheel configuration, all one needs to do is change the relative spin of any of the wheels thereby imparting a different spin to the ball and changing the trajectory. A main casting 80 to which powered wheels 12, 14, 16 and wheel motors 40, 42, 44 are affixed is integrated with guard members 22, 24, 25. Guards 22, 24, 25 block access to a large portion of wheels 12, 14 and 16 to prevent pieces that may result from fragments of a disintegrating wheel from hitting anyone near the apparatus including an operator and a batter. Guards 22, 24, 25 also prevent the operator from accidentally touching a moving wheel while operating apparatus 10. Such an occurrence might happen if the operator is watching the player during practice and not focusing on his operation of the apparatus. The wheels may rotate at speeds as fast as 3000 RPM with fourteen inch wheels propelling a ball as fast as 100 miles per hour or more. This is required in the operation of the apparatus since human pitchers are known to routinely pitch balls that fast. It should be understood that wheels of other sizes may also be used.

Wheel guards 22, 24, 25 are formed of metal (or another appropriate material such as plastic) that are shaped to cover all or significant portions of each of the wheels. The guards protect the rapidly spinning wheels from direct hits from balls successfully hit by the practicing person. This happens fairly regularly, and the wheel guards protect the wheels from such impact and from the damage such impact would cause. In particular, they prevent the ball from damaging the wheel to the extent that it might disintegrate, thereby preventing pieces or sections of the wheels from being launched at speed away from apparatus 10 that might endanger those standing nearby.

A support for ball propelling head 11 includes a tripod formed of legs 28, 30, and 32 each having a rubber safety tip 34. The support allows for stability on uneven ground and it may be adjustable to different heights. It may raise ball propelling head 11 high enough to approximate the height of a pitchers arm when he releases a pitched ball. A ball pitched from such a height will more accurately mimic a ball pitched by a human pitcher. The three wheels 12, 14, 16 in ball propelling head 11 form aperture 18 through which ball 20 to be thrown is visible just before it is launched by ball propelling head 11. Propelling head 11 is supported by a frame 36 that is pivotable to aim the ball in a particular direction. Three motors 40, 42 and 44 positioned at each wheel 12, 14, 16 propels each of the wheels independently of the others. Varying the speed of one or more of the wheels allows a second person, the operator, who is not the batter, but, perhaps a coach or another player, to provide a series of unknown pitches to the player having different types of spin such as a curve ball, a slider, a fastball, etc. The speed can be varied by the operator using the control box 54 having independent control knobs for each motor 40, 42, and 44 mounted on the support frame 36.

Motors 40, 42, 44 are mounted on main casting 80 with each motor positioned proximate to each wheel 12, 14, 16. Main casting 80 is attached to frame 36 by pinions 56 and 58. An elevational control 60 allows the operator to adjust the angle of propelling head 11 relative to the ground at which ball 20 leaves propelling head 11. This provides for pitch height adjustment in the up-down direction positioning the height of the ball trajectory as it passes in front of the batter. It also allows the machine to be adjusted for fielding practice. Aiming it low produces grounders, aiming it a mid-level produces line drives and aiming it high produces fly balls or pop-ups. The three variable speed motors 40, 42, 44 are each mounted on main casting 80, which also forms a surface onto which the feed chute 64, the wheel guards 22, 24, 25 and an elevation control 60 may be mounted.

Three tripod legs (28, 30, 32) along with head mounting frame 72 form a base 26 that allows a stable and transportable combination. Ball propelling head 11 is mounted atop base 26 by attaching it to head mounting frame 72. A first transport wheel 68 positioned on one side of pitching apparatus 10 and a second transport wheel 70 positioned on the opposite side of pitching apparatus 10 are attached to the backside of head mounting plate 72, and allow easy transportation of the pitching apparatus 10. The two rear tripod legs 28 and 32 are preferably removable and when the apparatus is on its wheels it can be guided by using the front tripod leg 30 as a steering lever.

A fine adjustment subsystem 100 is shown below propelling head 11 and mounted to an arm or platform 102 extending from base 72 and to which the top of front leg 30 is attached. Fine adjustment subsystem 100 allows the variation of a pitch trajectory to be finely adjusted for in the horizontal direction as it crosses the plate or other area in front of the batter (i.e. moving the pitch location from an inside pitch to an outside pitch within or outside the strike zone). Fine adjustment subsystem 100 is shown in more detail in FIGS. 4-5.

The three powered wheels 12, 14, 16 preferably each include a concave ball engaging peripheral surface to allow the maximum surface of the wheel to contact the ball as it passes the three wheels.

A three-wheeled propelling head 11 is configured to eliminate vision and spin problems. The arrangement of the wheels, that is, two on top and one on the bottom forms aperture 18 that allows the practicing player to view of the oncoming balls as they come down chute 64 before they are launched. This is also a safety feature since batters are less likely to be inadvertently hit by a pitch since they can see if one is in the works. Aperture 18, through which the ball must pass to get to the wheels, allows the practicing player to see ball 20 as it moves down chute 64 before it is launched towards him. The visibility of ball 20 allows the batter to get a sense of the timing of ball 20 coming so he can anticipate striding forward or whatever that player may do in preparation for hitting a ball pitched towards him or her. With three wheels (or two), all one needs to do is change the relative spin of any of the wheels and the ball will spin differently to emulate a different pitch or pitch type.

The invention has been described as being an apparatus for propelling balls, particularly stick-hittable balls. The preferred balls include, for example, baseballs, softballs, handballs, tennis balls, cricket balls, (baseballs, softballs, and cricket balls are specifically defined herein as the stick-hittable balls, and may be of slightly differing sizes and weights depending on the precise league and region of use) and the like can beneficially be used in the practice of this invention. The general key to the balls that would be beneficially used in this invention are those that are thrown to be struck or hit or the like by a player with a stick or glove or racket. The apparatus may also be used for practice with catching balls, including for fielding grounders, line drives, fly balls and pop-ups.

Figure 2:
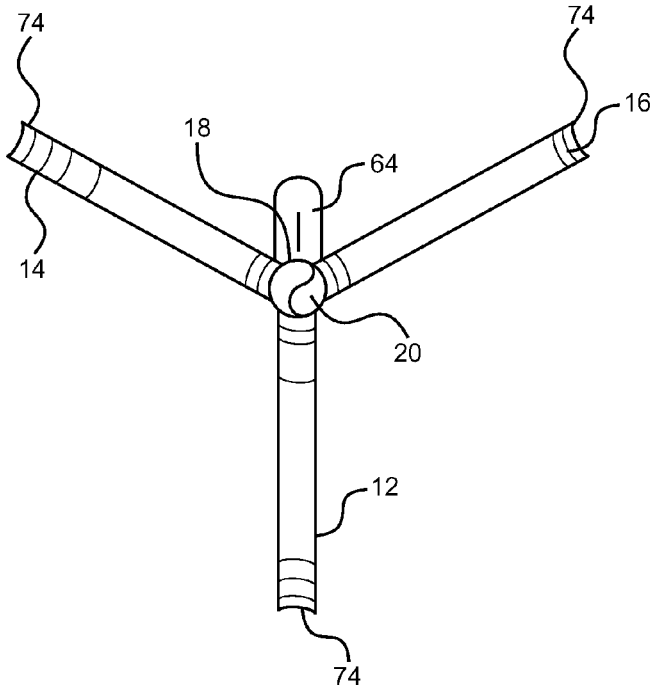
FIG. 2 is front schematic view of a ball propelling head of the system of FIG. 1.
Figure 3:
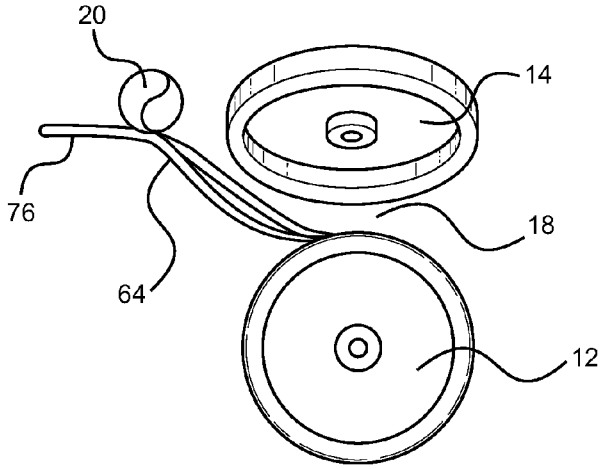
FIG. 3 is a side schematic view of the ball propelling head of the system shown in FIG. 1 and FIG. 2.

Referring to FIG. 2 and FIG. 3, the use of a three wheel configuration allows less wear on the balls used for practice than a configuration where only two wheels or one wheel are used. When used in practice, this arrangement provides more speed and better accuracy, while providing a better gripping surface between the balls and the wheels. The surface is further improved by using a concave surface for the contact surface 74 of the wheels. This is important since the balls are being accelerated from zero to perhaps one hundred miles per hour in a fraction of a second. Aperture 18 is shown as being defined by interstitial space between the three wheels 12, 14, 16. Ball 20 will always roll downwardly through chute 64; therefore, the player will always have a view of the ball immediately before it is launched towards him. Propelling head 11 (shown in FIG. 1) is mounted on frame 36 which pivots. Ball 20 rolls down chute 64 to the area where the edges of three wheels 12, 14, 16 come together.

A chute handle 76 is affixed to the end of chute 64. Chute handle 76 may be gripped by an operator of apparatus 10 to pivot throwing head 11 around pivot point 122 to adjust the horizontal trajectory of a ball pitched from throwing head 11. This movement is useful for large scale pivotal movements of throwing head 11. For micro-movements or fine, highly accurate small adjustments, the operator may use the fine adjustment subsystem 100 shown in detail in FIGS. 4-5.

Figure 4:
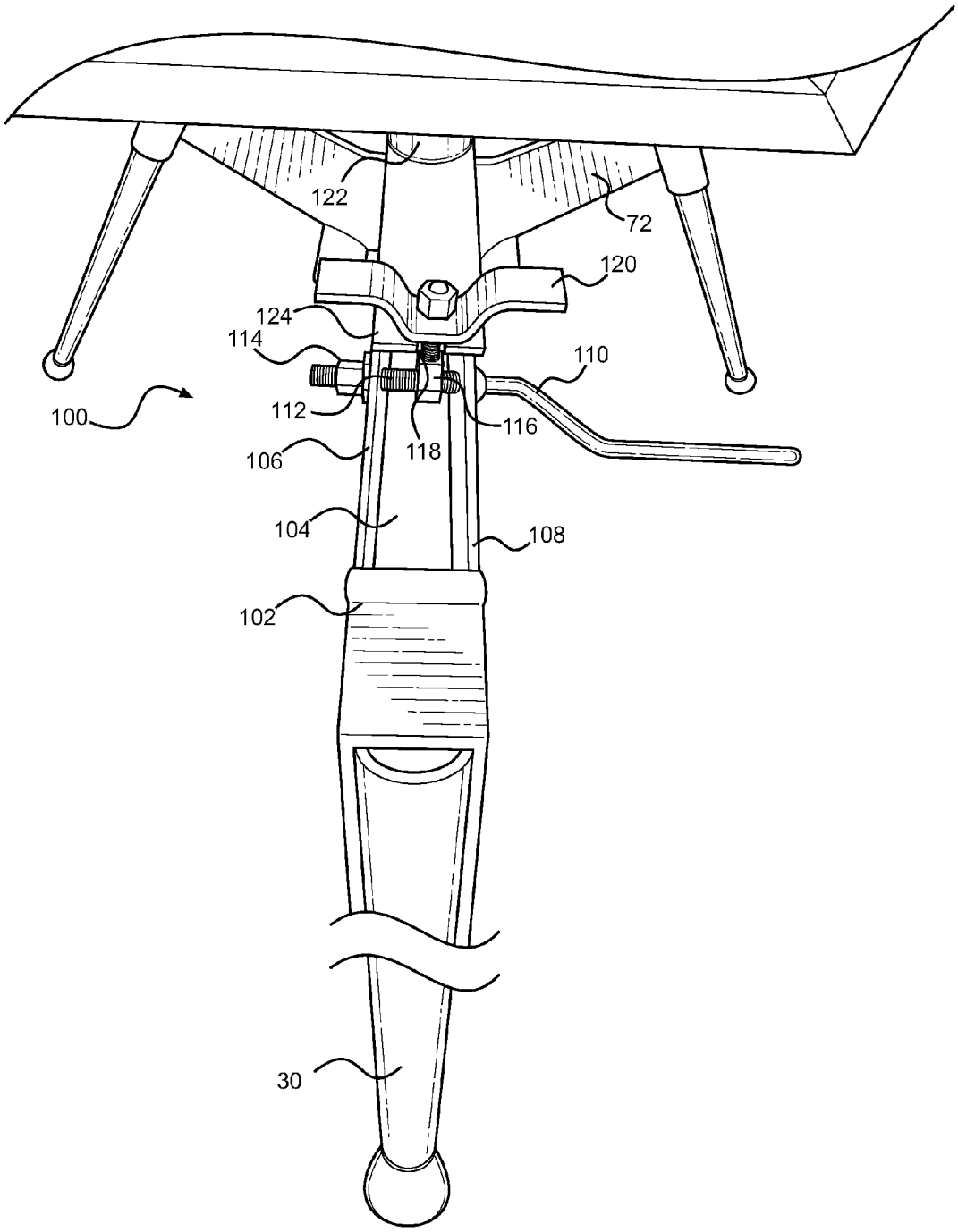
FIG. 4 is a front perspective view of a detail of FIG. 1 showing a fine adjustment subsystem.
Figure 5:
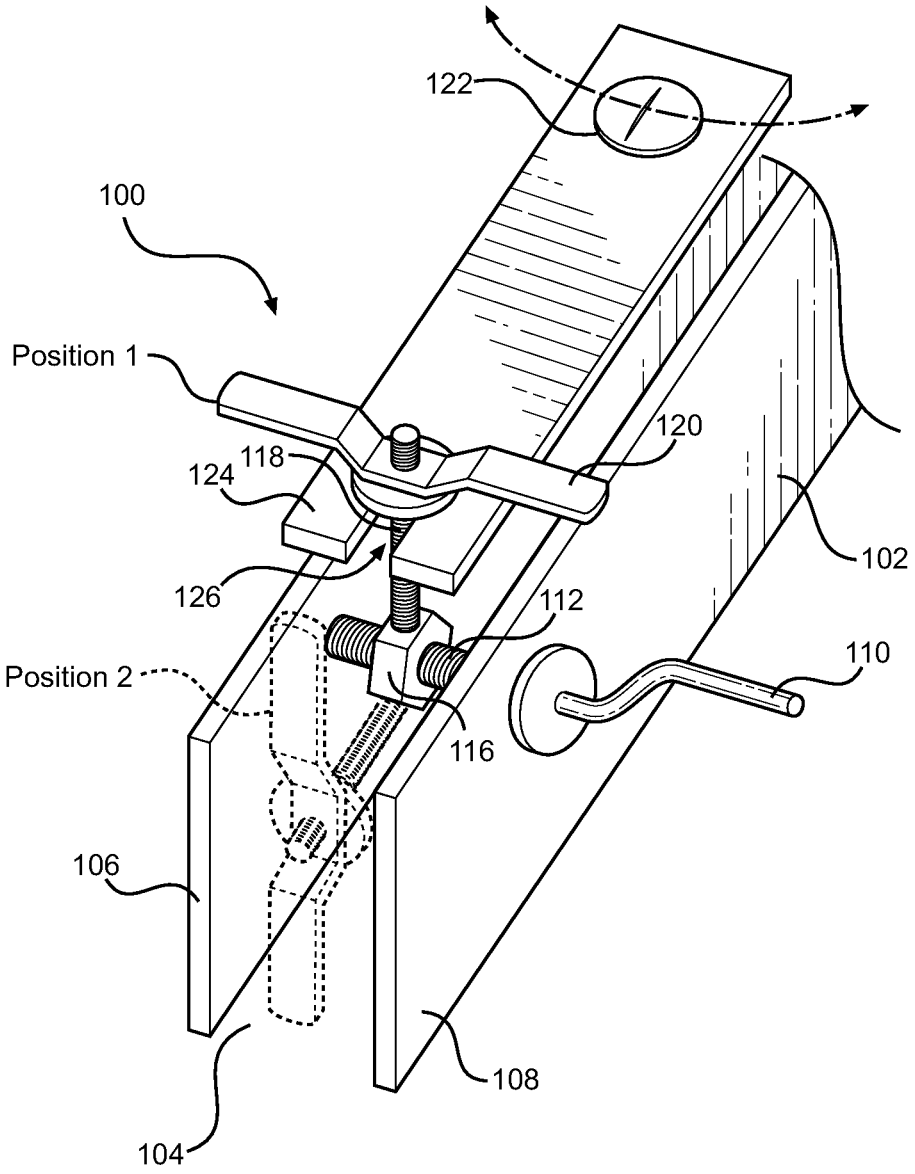
FIG. 5 is a detailed angled perspective view of the fine adjustment subsystem of FIG. 4.

FIG. 4 is a front perspective view of a detail of FIG. 1A showing fine adjustment subsystem 100, and FIG. 5 is a detailed angled perspective view of fine adjustment subsystem 100 of FIG. 4 showing the two positions of a locking mechanism for use in the subsystem. Referring to FIGS. 4 and 5, subsystem 100 is configured to allow an operator to finely adjust the horizontal position of propelling head 11. The fine adjustment varies a trajectory of a pitch in a horizontal plane as it crosses the plate or other area in front of the batter (i.e. moving the pitch location from an inside pitch to an outside pitch within or outside the strike zone).

Subsystem 100 is formed of platform or arm 102 which has two side frames 106, 108 and a gap 104 between them. A crank 110 with a threaded portion 112 is fitted between side frames 106 and 108 and is held in place by a nut 114 on the opposite side of platform 102 from crank 110. An adjustment nut 116 on threaded portion 112 of crank 110 moves back and forth on threaded portion 112 between side frames 106 and 108 in gap 104 as crank 110 is turned. A locking mechanism formed of an extension rod 118 attached to adjustment nut 116 has a winged lock 120 mounted to the end of rod 118. Loosening and tightening of winged lock 120 allows rod 118 to be adjusted during operation of the pitching apparatus 10. A pivot point 122 on tongue 124 is located near the end of arm 102 through which an axis passes and about which propelling head 11 pivots on frame 36 in continuous fine adjustment increments as crank 110 is turned to move tongue 124 on which throwing head 11 and frame 36 are pivotally mounted.

FIG. 5 shows the operation of fine adjustment subsystem 100 and the disengagement of rod 118 for large scale adjustment. In a first position, extension rod 118 is positioned within a slot 126 in the end of tongue 124. In this first position (Position 1), winged lock 120, which is screwed onto extension rod 118 can be tightened down and locked onto tongue 124 to hold it in place at a desired position. Once fine adjustment 100 is locked, operation of pitching device 10 will pitch balls along a particular directory and each pitch will be on the same trajectory. To finely adjust the trajectory so that ball placement is more to the inside or outside relative to the batter, winged lock 120 is loosened but maintained in the first position inside of slot 126 on tongue 124. In this position with lock 120 loosened, tongue 124 moves with rod 118 in either position about pivot point 122. By turning crank 110 one way or the other, adjustment nut 116 is repositioned along threaded portion 112 of crank 110. Using this operation, slight adjustments can be made by the operator after each pitch. If a single positioned is desired for practice, winged lock 120 is rotated to tighten it down against tongue 124 to hold it firmly in that desired position. That way, a player can practice a pitch with a particular trajectory over and over again. Tightening down wing lock 120 ensures that the recoil of the throwing head does not make any slight movements to the position between pitches.

It should be understood that the rotation of crank and the adjustment of extension rod 118 is in very small increments because it is moved along the threads of threaded portion 112 of crank 110. This allows an operator to vary the horizontal pitch location very slightly across the strike zone of the batter standing at the plate 60 feet and 6 inches away. For the full range of the crank, the difference in horizontal pitch position for the batter may be, for example, approximately in the range of 12 to 18 inches. It could be made more or less depending what's desired. The ease and speed with which the horizontal pitch position may be adjusted using subsystem 100 means that an operator can vary pitch location between each pitch in minimal time.

For large changes in the horizontal position of the trajectory, particularly for fielding practice where it may be desirable to launch balls to players at different positions with each throw either for the practice of ground balls, line drives, fly balls and pop-ups for either infielders or outfielders, wing lock 120 is loosened and rotated down into position 2 between frame elements 106 and 108. With rod 118 rotated down and out of slot 126 on tongue 124, tongue 124 freely rotates around pivot point 122. An operator of apparatus 10 uses handle 76 on the end of chute 64 to rotate throwing head 11 to any desired position. Throwing head 11 may be maintained in one position for multiple throws or rotated by the operator after each throw to generally aim the ball trajectory in the area of a player. Even though the recoil of the throwing head may slightly alter the position of a throw while winged lock 120 is in Position 2 and tongue 124 is free to rotate about pivot point 122, any slight changes resulting from the recoil are not significant for fielding practice in the same way as batting practice where small adjustments and maintaining a particular position are more critical.

In an alternative embodiment, tongue 124 may include a hinged portion with a set of teeth at the end to engage a toothed gear attached to the top of arm 102 and with a handle for turning the toothed gear. Hinged portion has a first position where it engages toothed gear and a second position where it swings out of engagement with toothed gear. In that way, it operates in the same manner as the first embodiment with a first mode for small adjustments and a second mode for large adjustments. When in the first position, tongue 124 may be clamped against arm 102 to maintain tongue 124 and throwing head 11 in the same position for multiple throws.

While the invention has been described with respect to the FIGS. 1-5, it will be appreciated that many modifications and changes may be made by those skilled in the art without departing from the spirit of the invention. Any variation and derivation from the above description and drawings are included in the scope of the present invention as defined by the claims.

The invention claimed is:

1. An apparatus for pitching practice balls comprising:

a ball propelling head, the head supported by a head frame and having at least one wheel, the at least one wheel arranged to define an aperture through which a ball is propelled;

a base to which the head frame is pivotally attached at a distance above the ground;

a motor for each of the at least one wheels, each motor powering one of the wheels; and an adjustment subsystem for varying a position of a trajectory of the ball, the subsystem comprising:

a tongue that pivots with the head frame about a pivot axis, wherein the tongue has two operational positions:

a first position in which the tongue is engaged with a fine adjustment mechanism; and a second position in which the tongue is disengaged from the fine adjustment mechanism wherein the head frame is freely pivotable.

2. The apparatus of claim 1 further comprising a lock positioned with respect to the tongue to maintain the tongue and the head frame in a desired position.

3. The apparatus of claim 2 wherein the adjustment subsystem further comprises:

a slot in a first end of the tongue;

a gap in a portion of the base;

a threaded rod positioned in the gap;

an adjustment nut positioned in the gap and through which the threaded rod passes; and an extension rod having a first end attached to the adjustment nut and a second end that fits within the slot on the tongue when the extension rod is in the first position and that is not within the slot when the extension rod is in the second position.

4. The apparatus of claim 3 wherein the lock is positioned on the second end of the extension rod and is tightened to maintain the tongue in a desired position when the extension rod is in the first position and loosened to allow the tongue to be pivotally adjusted to a different position by the adjustment subsystem while the extension rod remains engaged with the slot.

5. The apparatus of claim 3 wherein loosening the lock allows the extension rod to be disengaged from the slot and moved to the second position.

6. The apparatus of claim 1 further comprising a ball chute having a first end attached to the ball propelling head and a second end on which balls are placed by a user for pitching.

7. The apparatus of claim 5 further comprising a chute handle attached to the first end of the ball chute that is used to pivot the head frame about the pivot axis to adjust the horizontal trajectory of a ball pitched.

8. The apparatus of claim 1 wherein the adjustment subsystem is configured in a portion of the base proximate an area where the head frame is pivotally attached to the base.

9. The apparatus of claim 1 wherein the base comprises at least three legs.

10. The apparatus of claim 9 wherein one of the at least three legs further comprises an extended portion in which the adjustment subsystem is housed.

11. An method for pitching practice balls, comprising the steps of:

providing a ball propelling head, the head supported by a head frame and having at least one wheel, the at least one wheel arranged to define an aperture through which a ball is propelled;

pivotally attaching the head frame to a base at a distance above the ground;

powering each of the at least one wheels using a separate mounted to the ball propelling head; and adjusting a position of a trajectory of the ball using an adjustment subsystem, the subsystem comprising:

a tongue that pivots with the head frame about a pivot axis, wherein the tongue has two operational positions:

a first position in which the tongue is engaged with a fine adjustment mechanism; and a second position in which the tongue is disengaged from the fine adjustment mechanism wherein the head frame is freely pivotable.

12. The method of claim 11 wherein a lock is positioned with respect to the tongue to maintain the tongue in place.

13. The method of claim 11 wherein the adjustment subsystem further comprises:

a slot in a first end of the tongue;

a gap in a portion of the base;

a threaded rod positioned in the gap;

an adjustment nut positioned in the gap and through which the threaded rod passes; and an extension rod having a first end attached to the adjustment nut and a second end that fits within the slot on the tongue when the extension rod is in the first position and that is not within the slot when the extension rod is in the second position.

14. The method of claim 13 wherein the lock is positioned on the second end of the extension rod and is tightened to lock the tongue in a desired position and loosened to allow the tongue to be pivotally adjusted to a different position.

15. The method of claim 13 wherein loosening the lock allows the extension rod to be disengaged from the slot and moved to the second position.

16. The method of claim 11 wherein a ball chute having a first end attached to the ball propelling head and a second end on which balls are placed by a user for pitching.

17. The method of claim 16 wherein a chute handle is attached to the first end of the ball chute that is used to pivot the head frame about the pivot axis to adjust the horizontal trajectory of a ball pitched.

18. The method of claim 11 wherein the adjustment subsystem is configured in a portion of the base proximate an area where the head frame is pivotally attached to the base.

19. The method of claim 11 wherein the base comprises at least three legs.

20. The method of claim 19 wherein one of the at least three legs further comprises an extended portion in which the adjustment subsystem is housed.

* * * * *